US005806343A

United States Patent [19]

Yoo

[11] Patent Number: 5,806,343

[45] **Date of Patent: *Sep. 15, 1998**

[54] BRACELET

[76] Inventor: Tae Woo Yoo, 807, 1-Dong, Hanyang, Apt. 32-5, Banpo-dong, Seocho-ku, Seoul, Rep. of Korea

[ * ] Notice: The term of this patent shall not extend beyond the expiration date of Pat. No. 5,689,947.

[21] Appl. No.: 804,170

[22] Filed: Feb. 21, 1997

[30] Foreign Application Priority Data

Feb. 23, 1996 [KR] Rep. of Korea ..... 1996 3022
Jul. 15, 1996 [KR] Rep. of Korea ..... 1996 20833

[51] Int. Cl.[6] ..... A44C 5/02

[52] U.S. Cl. ..... 63/3.1; 63/3.2; 63/9

[58] Field of Search ..... 63/3, 3.1, 3.2, 63/5.1, 7, 9; 59/80, 82, 84, 85, 78

[56] References Cited

U.S. PATENT DOCUMENTS 3,965,971 6/1976 Kodera ..... 59/80
4,960,232 10/1990 Kienhofer ..... 63/3
5,154,047 10/1992 Takagi ..... 63/3

FOREIGN PATENT DOCUMENTS 96-6881 8/1996 Rep. of Korea .

*Primary Examiner*—Kien T. Nguyen
*Attorney, Agent, or Firm*—Richard M. Goldberg

[57] ABSTRACT

A bracelet includes a set of linked bases, each base including a first body, a pair of parallel extended portions connected to opposite edges of the body, a projection positioned on a bottom of each extended portion for applying a finger pressure, a beam fixedly mounted to an extending between ends of the extended portions, and a polygonal shaped arm having one end connected with the body and being movable between a raised postion, for inserting the beam of a second base between the arm and the body, and a folded postion to fix the beam of the second base between the arm and the first body; a lock member connected to one end of the linked bases; and a link member connected to the other end of the linked bases.

7 Claims, 3 Drawing Sheets

BRACELET

BACKGROUND OF THE INVENTION

1. Field of the Invention

The present invention relates to a bracelet and more particularly this invention has a projection for practicing finger pressure.

2. Description of the Prior Art

In general, a bracelet has various forms used to ornament most women with accessories. In view of a recent trend of requesting that a bracelet has special functions as well as an ornamental function, this invention was created.

In order to satisfy the above-identified request, there was a previous application with the application no. 93-15106 in Korea. That invention comprises a set of linked bases, each base including a pair of parallel separated portions, a beam fixedly mounted between ends of the separated portions, an arm having one end connected between the separated portions, for inserting the beam of a second base between the arm and the first base, and a folded position to fix the beam of the second base between the arm and the first base, and a finger-acupuncture postioned on a bottom of at least one separated portion for applying a finger-acupuncture; a lock member connected to one end of the linked bases; and a link member connected to the other end of the linked bases.

Usually the finger-acupuncture bracelet was used as an accessory, by putting it on the wrist. And, when some symptom was generated or someone needs to protect against a malady, it could be used to remedy and protect the condition of a patient with a finger-acupuncture which is positioned inside thereof, by applying an acupuncture at a region for acupuncture of the palm of a hand or fingers.

However, whenever the bracelet was moved a little bit or was touched by something, it was easy to scratch or to pierce one's skin, because a sharp finger-acupuncture was positioned inside of the bracelet projected therefrom. Thus, it is not good that the finger-acupuncture bracelet was used as an accessory.

SUMMARY OF THE INVENTION

The object of the present invention is to provide a bracelet which can have an ornamental effect as an accessory and have an effect of a finger-pressure in connection with blood relationship of the wrist without hurting the skin.

According to the invention. to accomplish the above object, a bracelet comprises a set of linked bases, each base including a first body, a pair of parallel extending portions connected to opposite edges of the body, a projection positioned on a bottom of at least one extended portion for applying a finger-pressure, a beam fixedly mounted to and extending between ends of the extended portions, and an arm having one end connected with the body and being movable between a raised position, for inserting the beam of a second base between said arm and said first body, and a folded position to fix the beam of the second base between said arm and said first body; a lock member connected to one end of the linked bases; and a line member conected to the other end of the linked bases.

BRIED DESCRIPTION OF THE DRAWINGS

The objects and features of the present invention will be hereinafter explained in detail with reference to the accompanying drawings, wherein.

DESCRIPTION OF THE PREFERRED EMBODIMENTS

Figure 1:
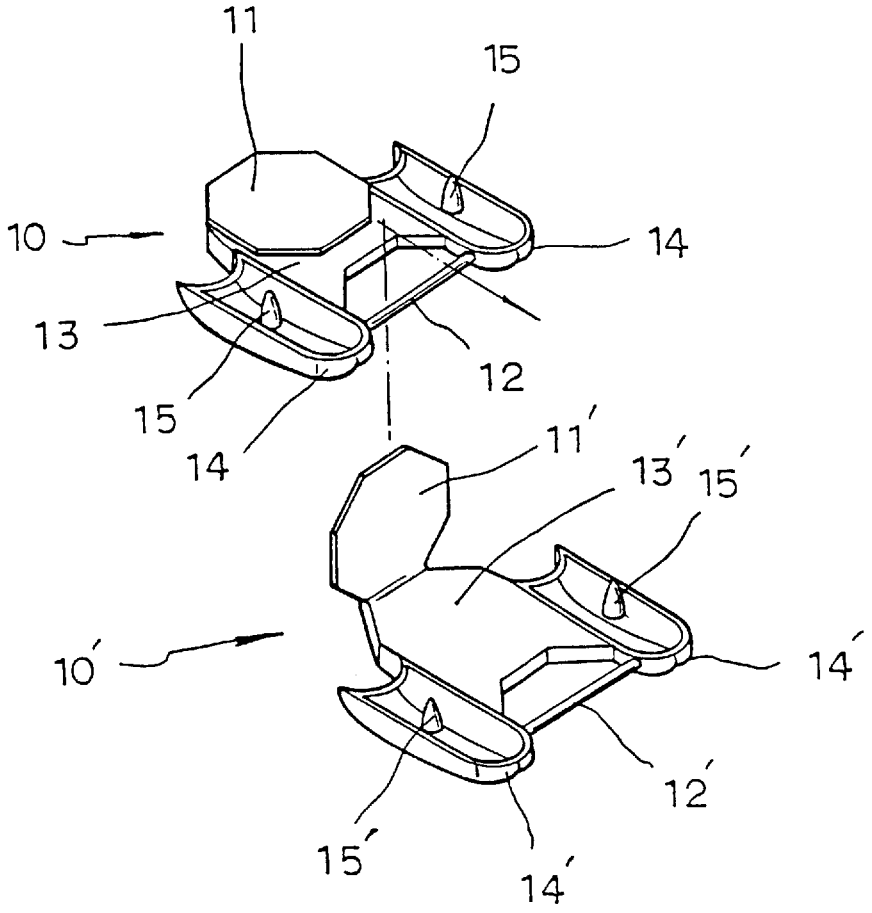
FIG. 1 is an exploded perspective view from the bottom of two bases.

As shown FIG. 1, the polygonal unfolded or raised arm 11' is inserted to the beam or rod 12 of another base 10 and then is folded.

Figure 2:
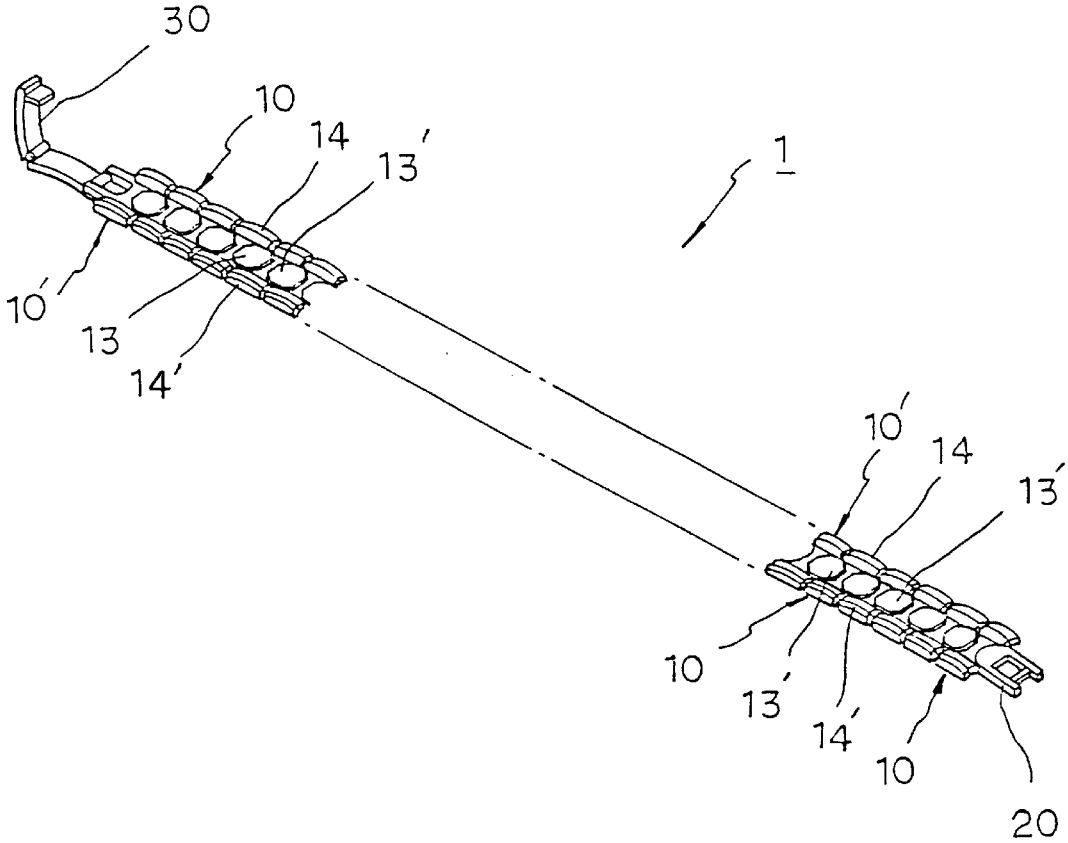
FIG. 2 is a perspective view of the entire bracelet.

As shown FIG. 2, a plurality of the bases 10,10' which are connected to the base 10 continuously are united to form one bracelet 1.

The one end arm 11,11' of the bracelet 1 is connected to a lock member 30 and rod 12 at the other end of the bracelet is connected to a link member 20.

Figure 3:
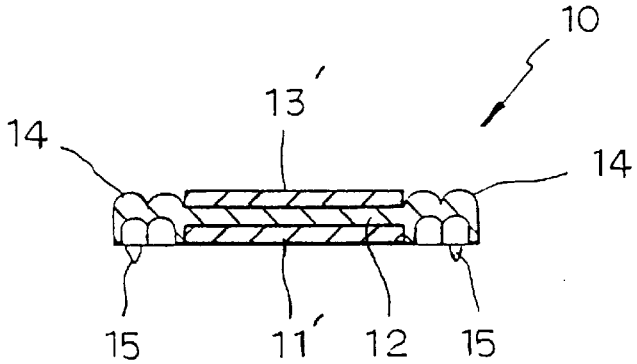
FIG. 3 is a connected sectional view of the bases.
Figure 4:
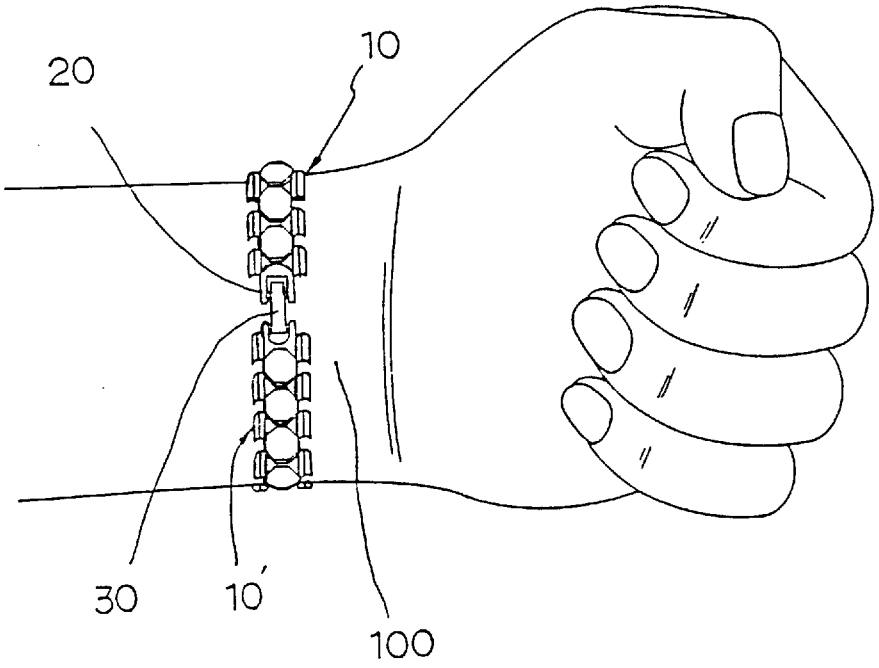
FIG. 4 is a perspective view of the bracelet worn on a wrist.

As shown FIGS. 3 and 4, in putting on the bracelet, the projections 15,15' which are positioned on the bottom of the extended portions 14,14' which are parallel and positioned at both edges of the body 13 stimulate and apply pressure to the wrist 100.

Therefore, the projections have effects of finger-pressure in connection with blood circulation by applying finger-pressure to the skin of the wrist and being an ornament by having the extended portion of a curved shape and the arm of a polygonal shape.

As mentioned above, this invention provides the bracelet with the special effect, by providing each base with the polygonal shape arm and the curved extended portions of the body and having the projection in the bottom of each extended portion, in putting on the bracelet, thus having an effect of finger-pressure in connection with blood circulation as well as an accessory.

What is claimed is:

1. A bracelet comprising:

a set of linked bases, each base including:

a first body, a pair of parallel extended portions connected to opposite edges of the body, a projection positioned on a bottom of at least one extended portion for applying a finger-pressure, a beam fixedly mounted to and extending between ends of the extended portions, and an arm having one end connected with the body and being movable between a raised position, for inserting the beam of a second base between said arm and said first body, and a folded position to fix the beam of the second base between said arm and said first body;

a lock member connected to one end of the linked bases; and a link member connected to the other end of the linked bases.

2. A bracelet according to claim 1, wherein opposite ends of said first and second sets of linked bases are connectable to each other.

3. A bracelet according to claim 1, wherein a said projection is positioned on the bottom of both extended portions of each base for applying a finger-pressure.

4. A bracelet according to claim 1, wherein each projection is positioned substantially centrally of the respective extended portion.

5. A bracelet according to claim 1, wherein each said extended portion is formed in an inverted trough shaped configuration, with a concave surface as an under surface and a convex surface as an upper exposed surface, and said projection is mounted to said concave surface.

6. A bracelet according to claim 1, wherein each said extended portion has a convex end and an opposite concave end, with the concave ends of the extended portions of said first base facing the convex ends of the extended portions of the second base.

7. A bracelet according to claim 1, wherein each said arm has a polygonal shape.

* * * * *